United States Patent [19]

Schwarz

[11] 4,341,583

[45] Jul. 27, 1982

[54] GARMENT BAG BOTTOM SEALING MACHINE FOR THE GARMENT MANUFACTURING AND DRY CLEANING INDUSTRIES

[76] Inventor: Karl E. Schwarz, 714 Tifft Ave., Horseheads, N.Y. 14845

[21] Appl. No.: 181,800

[22] Filed: Aug. 27, 1980

[51] Int. Cl.[3] ..... G05G 15/00; B29C 27/02; B65B 51/10

[52] U.S. Cl. ..... 156/359; 53/76; 53/241; 53/256; 156/583.4; 156/367; 156/366; 156/538; 198/728

[58] Field of Search ..... 156/581, 583.1, 583.2, 156/583.4, 359; 53/241, 256; 198/477, 678, 728; 414/745

[56] References Cited

U.S. PATENT DOCUMENTS

| | | | |
|---|---|---|---|
| 2,682,294 | 6/1954 | Lauger | 156/583.2 X |
| 3,196,068 | 7/1965 | Schoder et al. | 156/581 |
| 3,844,420 | 10/1974 | Walling et al. | 414/745 |
| 4,264,395 | 4/1981 | Tota et al. | 53/241 X |

*Primary Examiner*—David A. Simmons

*Attorney, Agent, or Firm*—Shoemaker and Mattare, Ltd.

[57] ABSTRACT

A garment bag bottom sealing machine used in a dry cleaning operation or garment manufacturing industry includes a V-link belt which receives hangers fed thereto one at a time by a feeder. A sealer on the machine effects a double seal of a garment bag, and the bagged garment is discharged from the machine for further processing. The sealing machine is separate from any other equipment used in a garment dry cleaning operation or garment manufacturing industry.

36 Claims, 8 Drawing Figures

GARMENT BAG BOTTOM SEALING MACHINE FOR THE GARMENT MANUFACTURING AND DRY CLEANING INDUSTRIES

BACKGROUND OF THE INVENTION

The present invention relates in general to garment dry cleaning or the garment manufacturing industry, and, more particularly, to sealing the bottom of garment bags after the bagging operation.

In the garment industries, garments are shipped on hangers, hanging on ropes inside trucks. During shipping pieces such as belts, vests, light blouses and the like slide off the hangers and fall onto the floor of the truck, where they get soiled and lost from the original package. The strong bottom sealed bag prevents these garments or parts from being separated from the original package and from loss and soil.

Heretofore, these garment bags have been placed on the garments and sealed in a single machine. Often, this single machine carries out still other operations on the garments, such as top sealing and bottom sealing in a sequential step.

Such single machine operations have several drawbacks. For example, should one part of the machine break down, or otherwise require service, the entire operation must be shut down. Furthermore, in a single machine operation, the overall operation can only be carried out as fast as the slowest step in the multistep operation. Since these operations are sequential, the production ratio is lowered.

Still further, some portions of an operation expose garments to soil. These operations are somewhat acceptable if they occur prior to cleaning and bagging of the garments. However, during, or after, such cleaning and/or bagging operations, the garments should not be exposed to soil and oil.

The single machine multistep operations are not amenable to adaptation with other and varied process steps. Hence, such machines are not versatile.

The single machine operations have also been found to be noisy and energy-inefficient.

A very serious drawback to these single machine multistep operations is the difficulty of controlling such machines. Only skilled operators can exercise proper control over such machines. The cost of these machines is thereby increased.

SUMMARY OF THE INVENTION

The device embodying the teachings of the present invention is very efficient and can be efficiently and reliably operated by unskilled operators.

The sealing device is separate from other machines and operations used in the processing of garments. The device includes a garment feeder which receives bagged garments. The bagged garments are then transferred, one at a time, to a conveyor belt which then moves the garments to a sealer which seals the bottom end of the bag. The garments are moved by the conveyor belt to a discharge end of that belt and discharged onto a downcomer which transfers the garments to a collection means which is used to move the bagged garments to a succeeding operation.

The device of the present invention serves only to bottom seal the bags containing the garments and is separate from other devices used in the bagging process. The device can be used in conjunction with any or all of the other devices commonly found in garment dry cleaning or manufacturing operations.

The conveyor belt is a V-link belt having a multiplicity of overlapping sections, each of which has a leading edge and a trailing section to which a succeeding section is integrally attached. A plurality of steps are formed by the conveyor belt. A projection, such as a rivet, or the like, is embedded in each conveyor belt section near the leading edge thereof.

The conveyor belt cooperates with a hanger guide rail to form hanger-accommodating pockets into which hangers are fed and trapped. A trapped hanger is conveyed to, and through, the sealing operation and to the discharge section whereat the hanger is released.

The belt needs no oil to convey the hangers and thus there is no potential for oil soiling clean garments. The belt is quiet, easily replaced and/or serviced, and thus enhances the adaptability of the overall sealing machine. The belt drive means used to drive the belt need not be large due to the efficiency with which the belt moves.

The sealing operation effects a double seal on each garment bag. Two lines of sealing are placed on the bag at locations which are spaced apart longitudinally of the bag with an unsealed portion located therebetween.

The double seal is quite reliable and strong and thus serves to enhance the protection of a garment offered by the garment bag.

Microswitches are used to sense the presence of hangers and garment bags. These switches are connected to a control unit which controls and regulates operation of the hanger feed means and the sealing means. The preferred embodiment of the present invention uses fluid cylinders to control hanger feed and to effect the sealing operation. Preferably, these fluid cylinders use air as the driving fluid.

The device of the present invention is separate from other devices used in a dry cleaning or manufacturing operation and hence can operate as fast as possible. The device is not subject to the speeds of other devices.

The device of the present invention need not be shut down if another device in the operation requires service or replacement. An overall process using this device is thus more efficient than those using a single multistep machine.

The sealing operation of the present device can be accurately set and carried out by an unskilled operator. The operator need only adjust simple dials on the control unit, and the machine does the rest. Thus, the overall cost of operation is reduced.

OBJECTS OF THE INVENTION

It is a main object of the present invention to effect a bottom bag sealing operation in a garment dry cleaning or manufacturing operation using a separate machine.

It is another object of the present invention to convey garments in a bag sealing machine without subjecting those garments to a possibility of oil soiling.

It is a further object of the present invention to accurately effect a bottom bag sealing operation in a garment dry cleaning or manufacturing operation using a separate machine without requiring complicated machine adjustments.

It is yet another object of the present invention to effect a secure seal of a garment bag in a garment dry cleaning or manufacturing operation.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
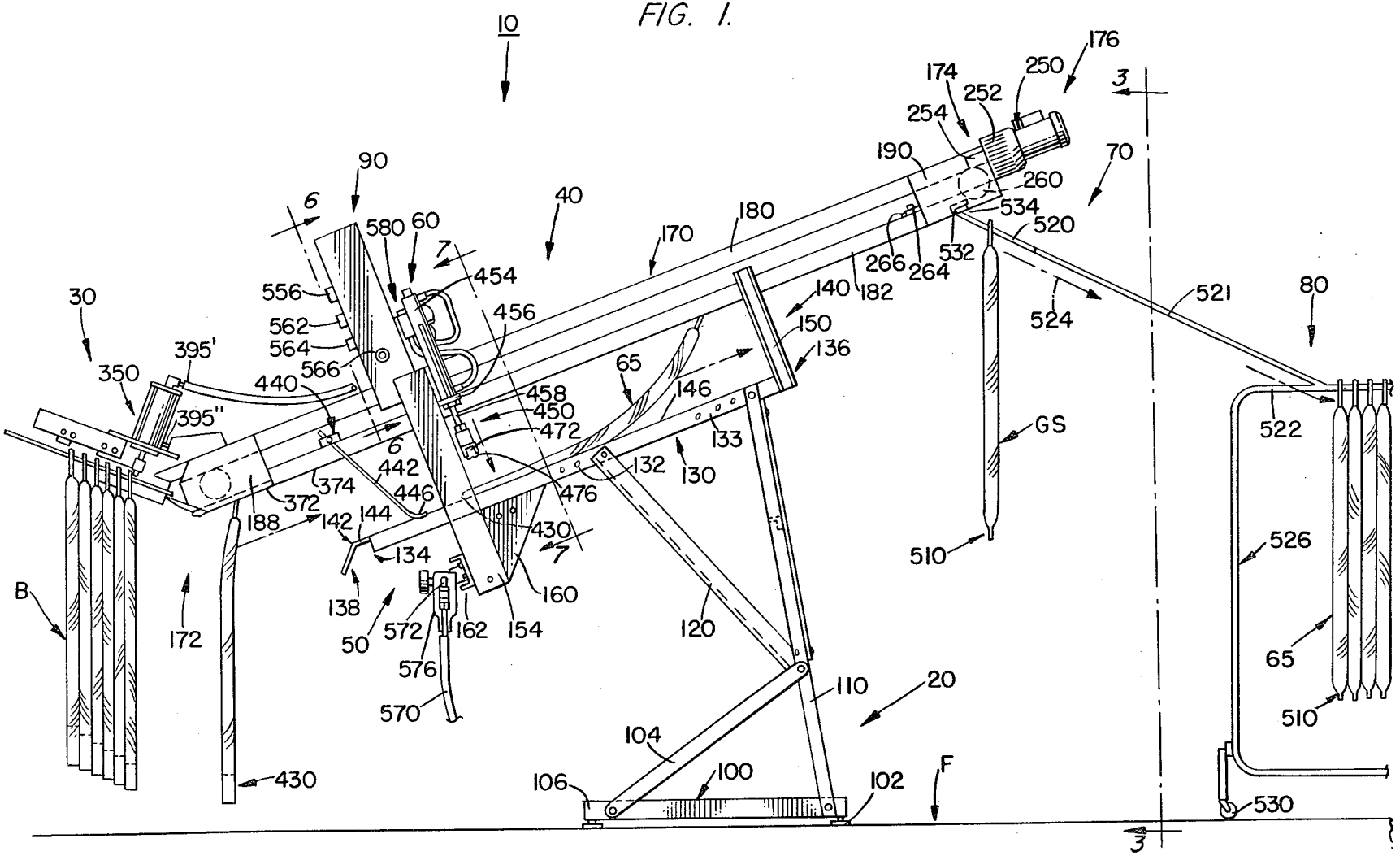
FIG. 1 is a side elevation of a garment bag sealing machine embodying the teachings of the present invention.

Shown in FIG. 1 is an automatic sealing unit 10 for sealing polyethelene or equivalent bags B containing garments or the like. The sealing unit is mounted on a support assembly 20 and includes a feeder assembly 30 which feeds bagged garments to a belt assembly 40. The belt assembly 40 conveys the bagged garments to a ramp assembly 50 and to a sealer assembly 60 where the bags are sealed, as will be discussed below. The sealed bags are delivered by the belt assembly to a discharge assembly 70 which delivers the sealed bags to a collection means 80 for storage and/or transport to other operations or the like. A control unit 90 coordinates and regulates the operation of the unit 10, and thus the feeding, conveying, sealing and discharging steps are all synchronized and properly sequenced by the control unit.

As shown in FIG. 1, the belt and ramp assemblies are mounted on the support assembly, the feeder, control and discharge assemblies are mounted on the belt assembly. The collection means is releasably associated with the discharge means.

Figure 3:
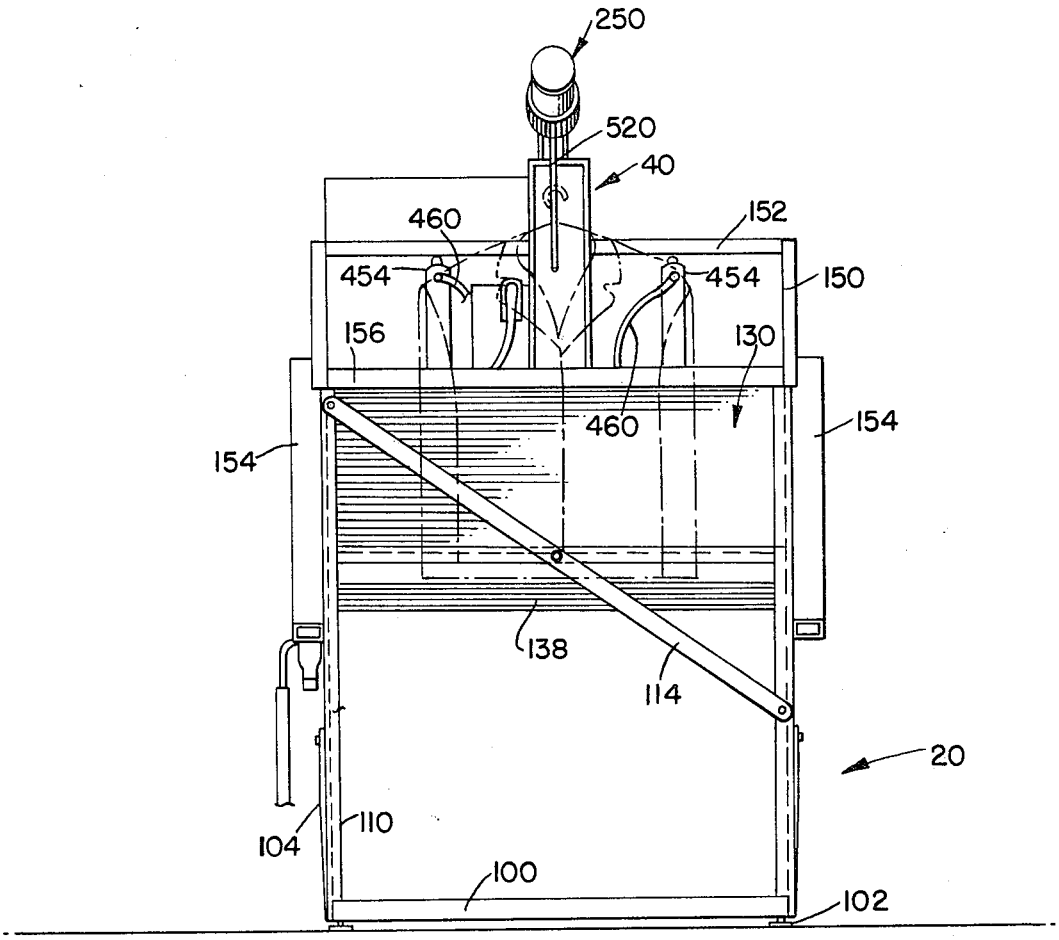
FIG. 3 is a view taken along line 3—3 of FIG. 1.

The support assembly 20 is best shown in FIGS. 1 and 3, and attention is directed to those figures. The support assembly includes a base 100 which can rest directly on a floor F, or can rest on the floor via vertically adjustable feet 102. The base 100 is preferably a polygonal plate and upwardly sloping braces 104 are each connected at a lower end thereof to sides 106 of the plate. The bases can be coupled to the plate by bolts or the like via bolt holes. There can be a plurality of bolt holes so the braces can be connected at various locations if suitable.

A pair of upwardly sloping struts 110 are each attached at a lower end thereof to the base plate via bolts or the like. The braces are attached to the strut at an upper end of the braces and between the ends of the struts. A plurality of bolt holes can be included so the struts and braces are adjustable if suitable.

As best shown in FIG. 3, a cross-piece 114 is connected at the ends thereof to the struts and is tilted.

Upwardly tilted prop bars 120 are connected at the lower ends thereof to the struts at or near the connection between those struts and the braces.

An upwardly inclined planar ramp plate 130 is connected to the upper ends of the prop bars and the struts as by bolts or the like. In the preferred embodiment, this plate is tilted at about 20°. A plurality of bolt holes 132 are defined in downturned side flanges 133 of the ramp to which the bars and struts are connected. The bolt holes 132 can be used to mount angle brackets (two on each side of the machine) and threaded rods for a ceiling mount thereby eliminating support assembly 20, if desired. The inclination of the ramp plate 130 is adjusted accordingly. The ramp plate includes a lower end 134 and an upper end 136, with a garment lead-in apron 138 integrally attached to the ramp lower end and a support frame 140 attached to the ramp upper end. The apron includes an angled flange 142 having a downwardly projecting face and an upper face 144 which is part of ramp plate upper face 146.

The support frame 140 includes a pair of upwardly projecting side support bars 150 each attached at a lower end thereof to the ramp and at an upper end thereof to the belt assembly 40 via a cross-brace 152 best shown in FIG. 3 and which is attached near the middle thereof to the belt assembly by bolting plates or the like.

Figure 4:
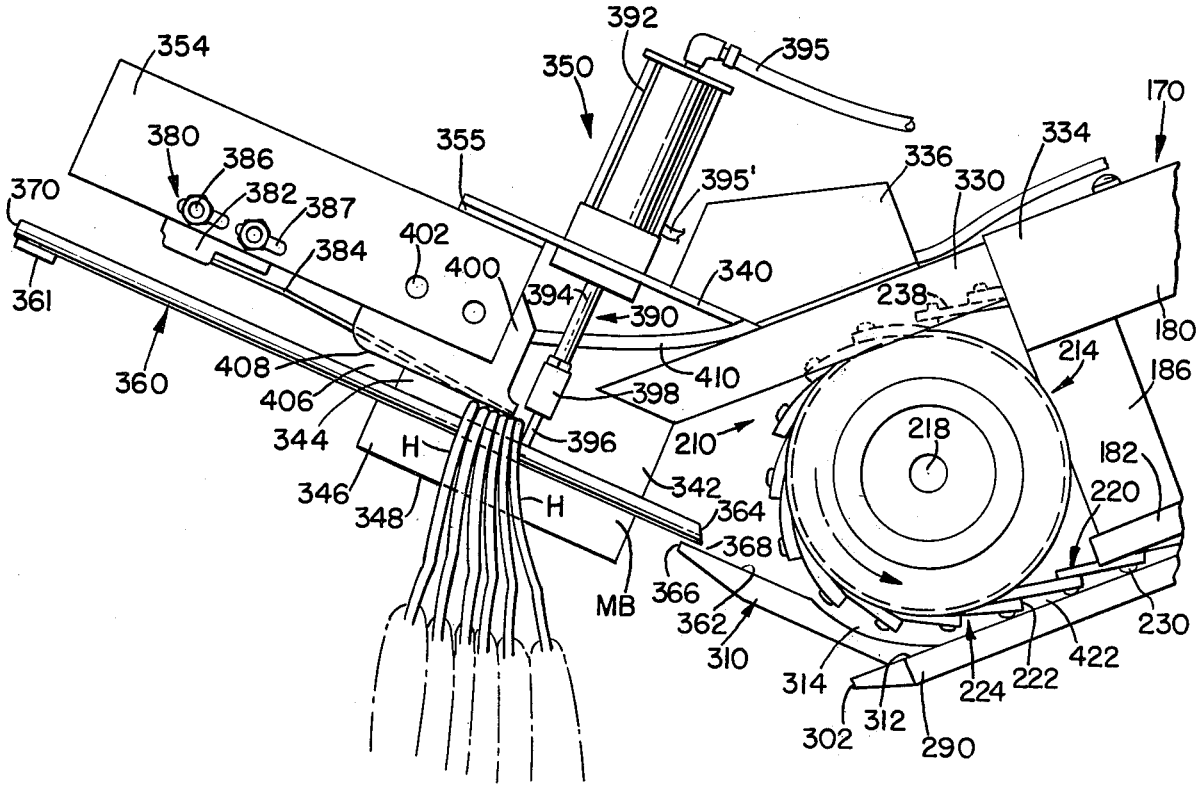
FIGS. 4 and 5 are elevation views showing a feeder means used with the garment bag sealing machine embodying the teachings of the present invention.
Figure 5:
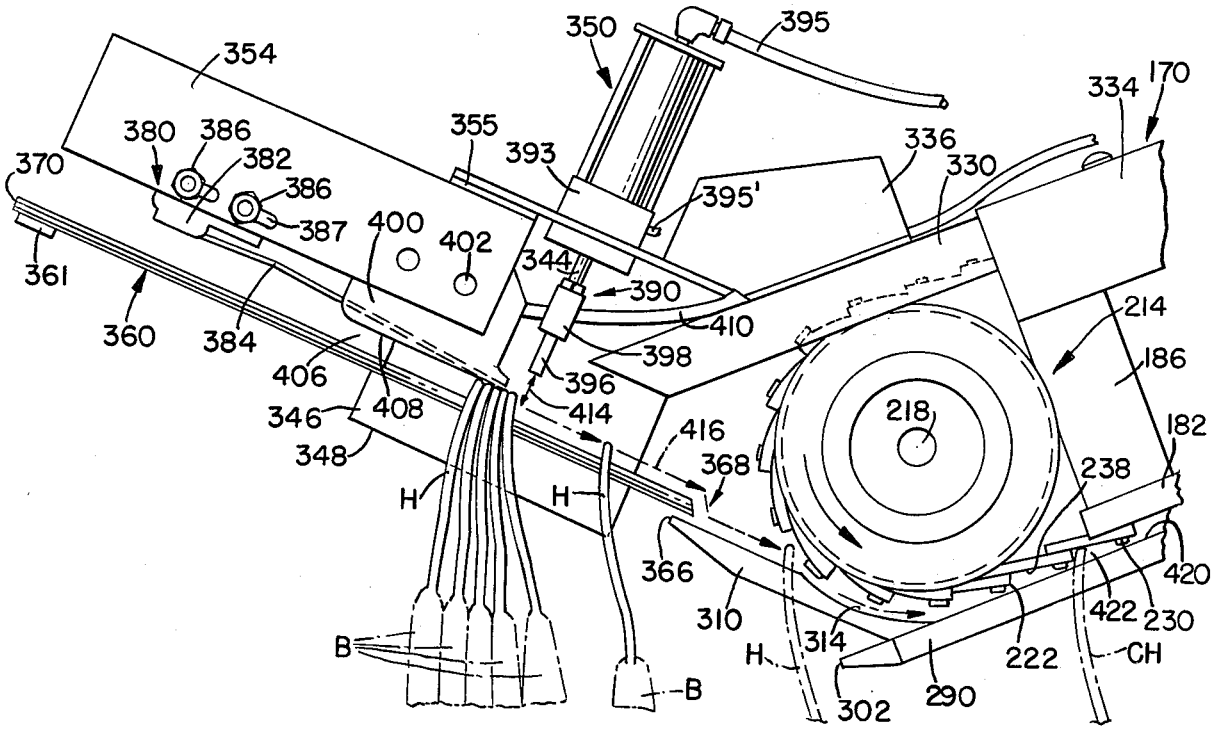

Pilaster-like braces 154 are attached to the ramp and to horizontal struts 156 which are attached to the belt assembly by bolting plates or the like. Gusset plates 160 further attach the ramp and the braces 154, and a cross-strut 162 interconnects the braces 154. The belt assembly 40 is best shown in FIGS. 1, 4 and 5, and attention is directed to those figures. The belt assembly includes a belt housing 170 attached to the braces 154 and to the frame 140 to be mounted on the support assembly via the ramp. The housing is upwardly inclined from a lower end 172 to an upper end 174 with the feeder assembly attached to the lower end and a belt drive assembly 176 attached to the upper end.

Figure 7:
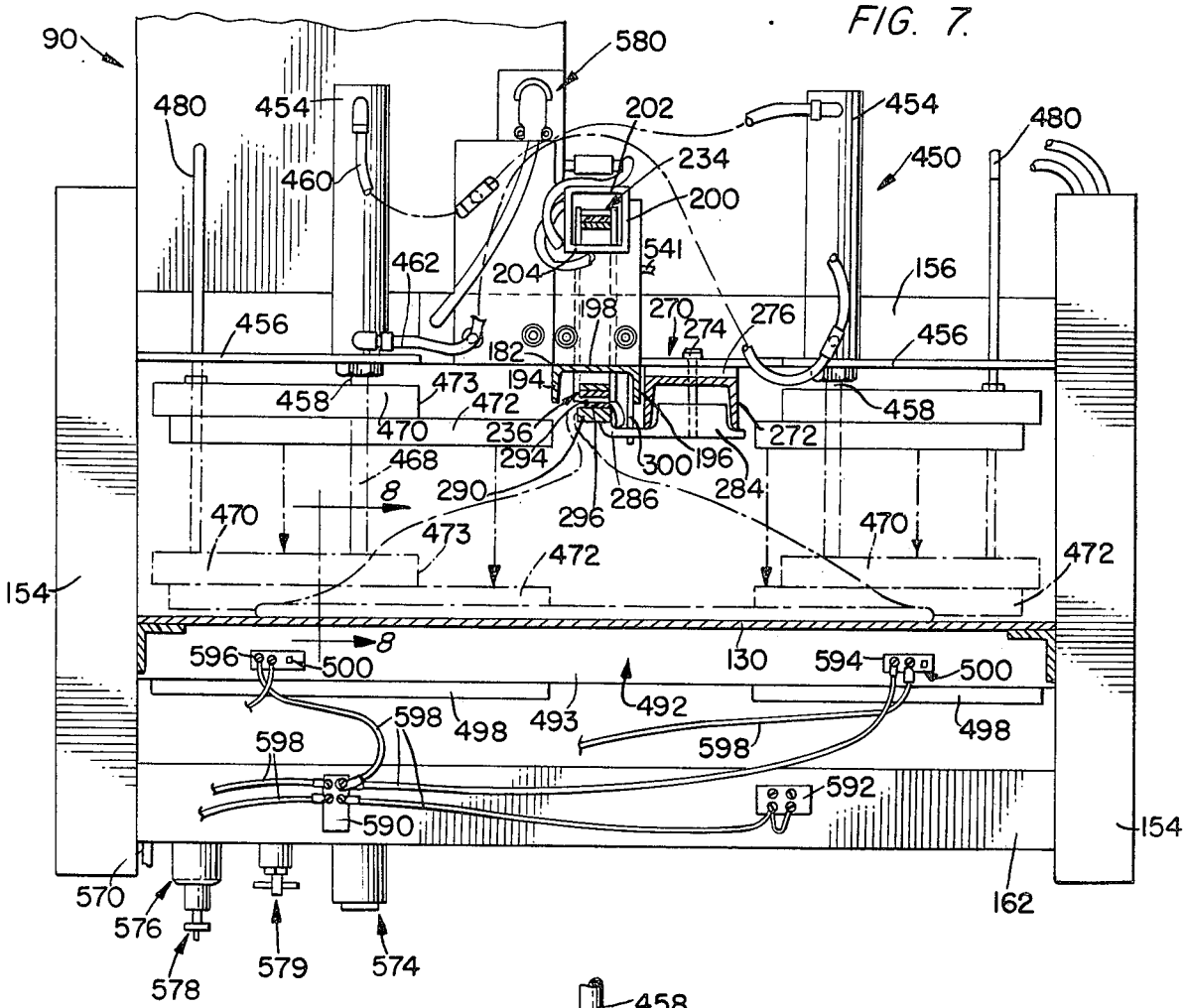
FIG. 7 is a view taken along line 7—7 of FIG. 1.

The housing includes an upper belt guard portion 180 and a lower belt guard portion 182 which are connected together by braces, such as brace 186, and by guard plates 188 and 190, as well as by the braces 154. As best shown in FIG. 7, the lower belt guard portion 182 is an inverted U-bracket having sides 194 connected together by a web 198. The upper portion 180 is box-shaped and includes a pair of sides 200, a top 202 and a bottom 204.

As best shown in FIGS. 4 and 5, a belt 210 is housed in the belt housing. The belt 210 is vertically oriented and is trained around an idler pulley 214 which is mounted on the belt housing by a bracket and an axle 218. The belt is unitary and includes a multiplicity of imbricated sections 220. Each belt section includes a leading edge 222 and a root end 224 to which is attached a following section. Protrusions, such as rivets 230, are mounted at or near the section leading edges. Adjacent sections are thus joined at verging portions which form the following ends of leading sections of a pairs of belt sections. The belt is vertically oriented to have an upper reach 234 housed in the upper guard portion an a lower reach 236 housed in the lower guard portion. The belt sections form V-links and the rivets 230 project above top surface 238 of each section a distance slightly less than the height of the following section as measured from the top of one section to the top of the following section. The thus-described belt 210 will also be referred to as a V-link belt. The purpose and function of the triple layered, riveted V-link belt 210 will be further discussed below.

The belt 210 is preferably a woven design having plastic-type materials therein. The belt is preferably formed of materials having a long life and which create only minimum amounts of friction when in sliding contact with other structural elements. Such low-friction contact eliminates the need for inserting lubricants between the belt and such other elements, thereby eliminating the potential source of soil for garments being bagged. The rivets 230 can be metal, but preferably are plastic-type material, such as Teflon, or the like, to comply with the above-discussed low-friction requirement.

The belt drive assembly 176 is mounted on the housing and includes a motor 250 which is preferably electric and which is connected to a clutch and brake assembly 252 and to a gear reducer and transmission unit 254. The units 252 and 254 connect the motor 250 to a drive pulley 260 around which the belt 210 is trained to be driven at the desired rate. A belt tension adjuster 264 is also mounted on the housing adjacent the belt drive assembly. The drive pulley and transmission 254 are mounted on a plate which is movably mounted, as by bolting or the like, to the belt housing and an elongate brace is adjustably mounted at one end thereof to the belt housing and at the other end thereof to the drive pulley. Belt tension is adjusted by releasing the elongate brace from the belt housing, adjusting the position of the drive pulley with respect to the idler pulley by adjusting the tension adjuster 264, then reconnecting the elongate brace to the belt housing. The tension adjuster preferably includes a cross-brace fixed to the belt housing and a screw 266 threadably mounted through the brace and engaging the movable plate so the plate is moved by movement of the screw 266.

Figure 2:
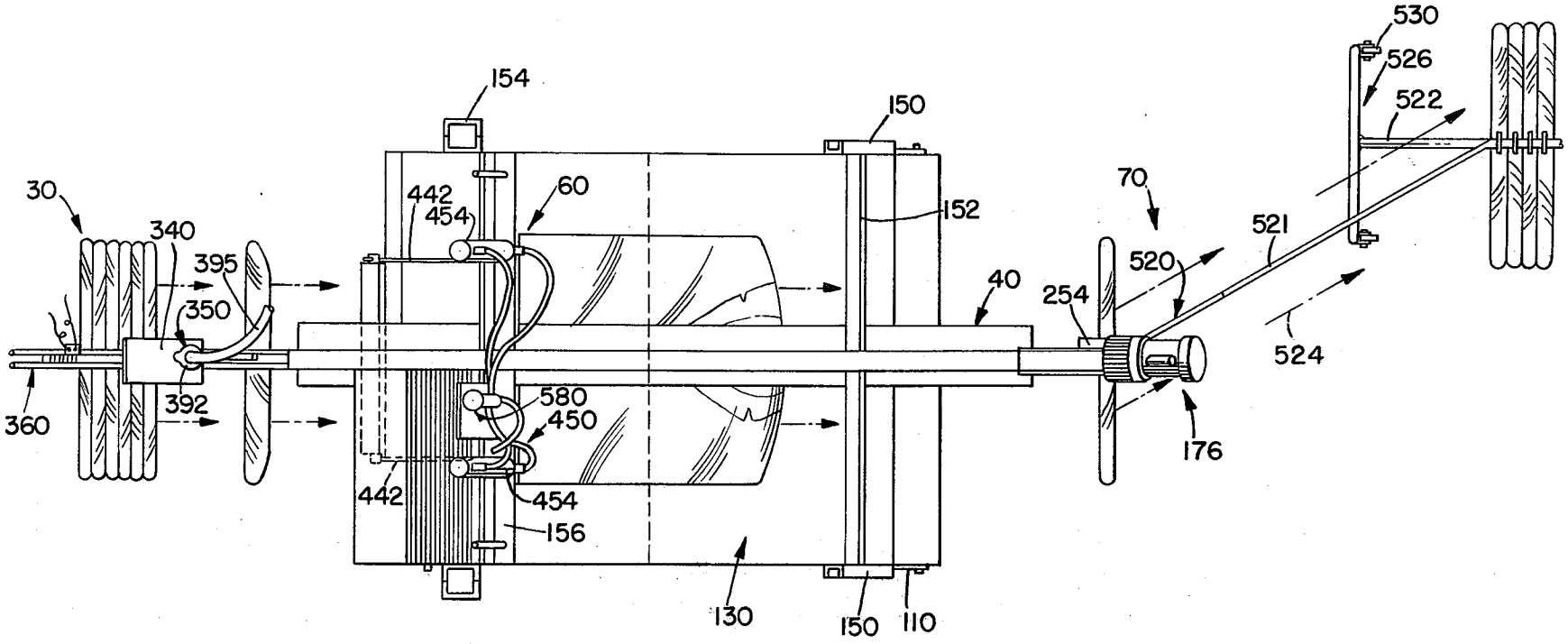
FIG. 2 is a plan view of a garment bag sealing machine shown in FIG. 1.

A hanger bar assembly 270 is best shown in FIG. 7 to include a U-shaped mounting bracket 272 attached via a bolt 274 and a spacer bar 276 to the strut 156 best shown in FIG. 2. A mounting bar 284 is attached to the mounting bracket via the bolts 274 and extends longitudinally of the belt housing, as does the mounting bracket. The mounting bar 284 includes a wing 286 which extends into the area beneath the belt lower housing portion. A hanger support bar 290 is mounted on the wing 286 to be located in longitudinal alignment with the lower reach of the belt 210 and to be spaced beneath such belt reach to define a hanger clearance gap 294. A layer 296 of abrasive-resistant, low-friction material is located on the top surface of the support bar 290 so that hangers H can easily slide on the bar 290. A hanger guide 300 is mounted on the housing lower portion, and is vertically oriented. As best shown in FIGS. 4 and 5, the hanger support bar 290 extends outwardly of the belt housing to a position beneath the idler pulley 214. Terminal end 302 of the bar 290 is essentially aligned with the outer periphery of the idler pulley in the preferred embodiment. It is noted that there are a plurality of hanger bar assemblies 270 in the preferred embodiment, and these assemblies are spaced longitudinally along the belt housing.

A hanger lead-in apron 310 is mounted as by welding, or the like, at one end 312 thereof on the hanger bar 290 at a location spaced from the terminal end 302 thereof. The apron 310 is angled upwardly from the bar 290 toward the belt housing upper portion. An arcuate section 314 is defined in the apron adjacent the end 312 for a purpose which will be discussed below.

A mounting channel 330 is adjustably attached at one end thereof to end 334 of the belt housing upper portion. The mounting channel extends outwardly of the upper portion and includes a pentagonal mounting block 336 mounted, as by welding or the like, thereon. A mounting flange 340 is affixed as by welding or the like to one face of the mounting block, and a J-shaped bracket 342 is integrally affixed to the mounting flange on a long leg 344 of the bracket, with a short leg 346 thereof being integrally attached to the leg 342 by a web 348 and being located beneath the flange 340.

The feeder assembly 30 is best shown in FIGS. 1, 4 and 5 and includes an escapement assembly 350 which controls the feeding of bagged garments to the apron 310. The escapement assembly includes a mounting bracket 354 attached as by bolting or the like via a shim 355 at one end of the bracket 354 to the mounting flange 340 and extends in a direction which is essentially parallel to the feed-in apron.

A hanger guide rail 360 is mounted by welding or the like near one end thereof on the bracket 342 by a mounting block MB which is affixed as by welding or the like to the bracket short leg 346, and which extends from the apron 310 in a direction which is essentially parallel with that apron. The guide rail preferably includes a pair of parallel bars interconnected by a tie plate 361 and is located slightly above top surface 362 of the apron and terminal end 364 of the rail is offset from the terminal end 366 of the apron toward the center of the apron to define a step 368. The guide rail outer terminal end 370 is free in the preferred embodiment, with the rail being entirely supported by the bracket leg 346. A triangular hanger deflector 372 can be mounted, as by bolting, or the like, to the belt housing lower portion to further control the movement of hangers along the guide rail 290 downstream of the idler pulley 214, if suitable. If desired, a plurality of such hanger deflectors can be used and mounted at aligned spaced locations along the belt housing. A hanger rail support beam 374 further supports the rail 290.

The shield 188 acts as an escapement guard and covers the idler pulley. The shield is mounted by bolts or the like to the belt housing.

A hanger feed control assembly 380 is mounted on the mounting bracket 354 and the flange 340. The control assembly 380 includes a microswitch 382 mounted on the bracket 354 and a switch arm 384 extending outwardly of the switch toward the feed-in apron 310. Fasteners, such as mounting bolts 386, or the like, are located in slots 387 and are used to mount the switch 382 on the bracket 354. The bolts can be moved in the slots to adjust the position of the microswitch when suitable. The switch arm is located near enough to the guide rail 360 to be tripped by a hanger H as that hanger moves along the guide rail toward the apron 310.

An escapement gate assembly 390 is mounted on the flange 340 and includes a fluid cylinder 392 mounted on the flange 340 by a collar 393 and which has an actuating rod 394 extending therefrom toward the hanger guide rail. The cylinder 392 also includes fluid lines 395 and 395' which serve the purpose usual to such elements. A shaft 396 is attached to the rod 394 by a coupling 398. The shaft 396 can be replaced as suitable. The cylinder actuates the shaft toward and away from the guide rail to contact that rail as shown in FIG. 4 and to be in a hanger passing position as shown in FIG. 5. The shaft acts as a type of tappet to permit hangers to pass from behind the gate assembly to the apron. A hanger guide bracket 400 is mounted on the bracket 354 by fasteners 402 or the like to define a gap 406 with the guide rail for guiding hangers to the shaft 396 to await feeding to the apron 310. The gap 406 is adjusted by moving the guide 400 as suitable.

The block 400 includes a pair of parallel arms between which the microswitch arm 384 fits, as best indicated in FIGS. 4 and 5. The block sides include lower edges 408 which can be slanted with respect to the hanger guide rail if so desired to further control the size and shape of the gap 406 as suitable for efficiently feeding hangers to the tappet shaft 396.

The microswitch 382 controls actuation of the cylinder via control line 410 in a manner which will be described below.

The shaft 396 follows the path indicated by arrow 414 in FIG. 5, and the hangers follow the path indicated by arrow 416 in FIG. 5. The step 368 serves to assure proper orientation of the hanger and the garment within the bag prior to that hanger being captured by the belt 210. The arcuate section 314 further orients the hanger properly with respect to the belt.

As best shown in FIGS. 4 and 5, the belt protrusions and top surfaces contact top surface 420 of the layer 296 to define hanger accommodating pockets 422. The hangers are wedgingly received in these pockets to be moved along the hanger guide rail 290 in the manner of a trolley harp toward ramp 50 and sealer assembly 60. A captured hanger is shown in FIGS. 1, 5 and 7, and is denoted by the reference indicator CH in FIG. 5. The apron arcuate section 314 feeds the hangers to the belt in a proper orientation.

The garment bag is moved along with the hanger toward the ramp 50 and onto that ramp as shown in FIG. 1. The garment bag is dragged along the ramp so that lower end 430 lies on the top surface of the ramp to be sealed by the sealer assembly 60.

Figure 8:
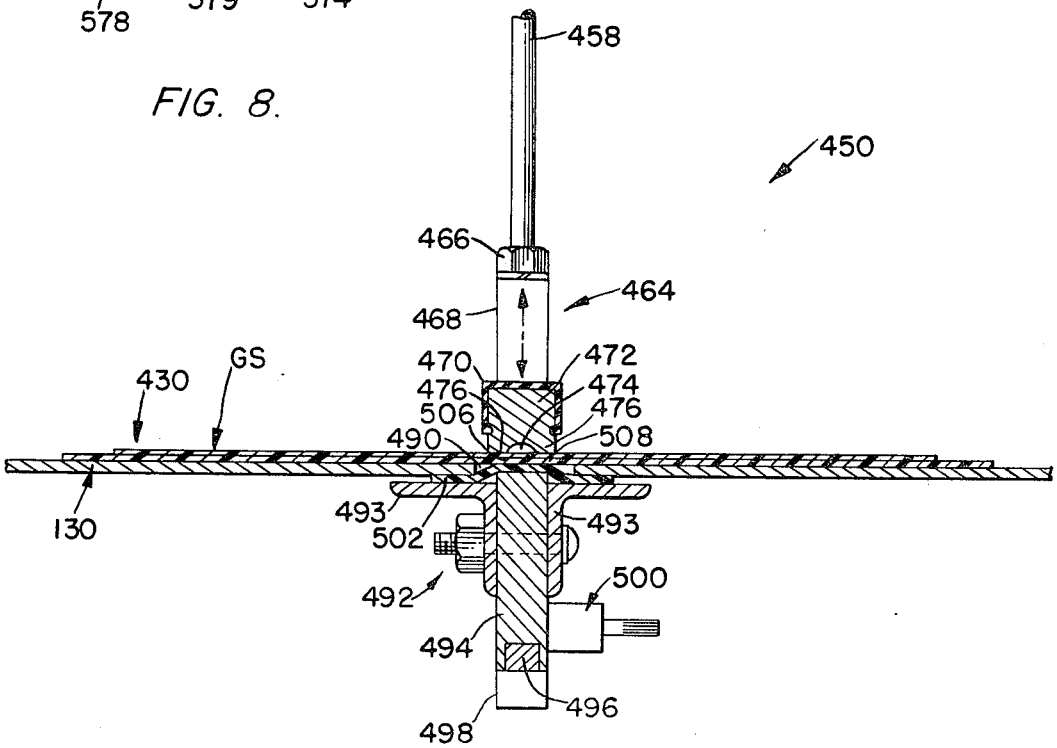
FIG. 8 is a view taken along line 8—8 of FIG. 7.

The sealing assembly 60 is best shown in FIGS. 1 and 8 and includes a microswitch 440 mounted on the belt housing lower portion and having switch arms 442 extending toward the ramp and each contacting such ramp with a foot section 446 oriented downstream of the movement of the bags. These arms act as bag sensors. Movement of a garment bag between the foot section 446 and the ramp trips the microswitch 440.

A bag sealer mechanism 450 is best shown in FIGS. 1, 7 and 8 as including a pair of fluid cylinders 454 mounted on the cross-brace 156 by angle brackets 456 which are mounted on the cross-brace 156 by bolting or the like. An actuating rod 458 is operated by each cylinder toward and away from ramp 50. Fluid lines 460 and 462 are also connected with each cylinder.

As best shown in FIGS. 7 and 8, each actuating rod 458 has a presser unit 464 affixed thereto by a fastener 466. Each presser unit includes a mounting shaft 468 attached to the actuating rod and a presser pad holder 470 mounted on the shaft 468. The holder 470 is U-shaped and an elongate presser pad 472 is mounted in the holder 470 and extends longitudinally beyond end 473 of the holder 470. The presser pad has an arcuate notch 474 defined longitudinally thereof to form wings 476. The presser pad is preferably silicone rubber.

A control rod 480 is slidably mounted in each of the brackets 456 to control the rods 458 and thereby insure proper movement of those actuating rods.

As best shown in FIG. 8, the ramp plate 130 has a gap 490 defined therein beneath each presser pad 472. A platen 492 is mounted on mounting brackets 493 to immediately subjacent the ramp plate 130. The platen 492 includes a sealing bar 494 having a heating element 496 attached thereto by a coupling element 498. A rheostat, or temperature control 500, is also mounted on the platen to control the heating element 496. A cover sheet 502 covers the top of the heated sealing bar to be interposed between that sealing bar and a garment pressed against the platen by pressure pad 472.

As shown in FIG. 8, a garment bag GS is captured between the presser pad and the heated cover sheet 502 as sealing is effected at locations 506 and 508 on the bag beneath the wings 476. A sealed end 510 is indicated in FIG. 1.

Actuation of the cylinders 454 is controlled by the microswitch 440 according to a predetermined time delay after the switch arms 442 sense the presence of a bag. The time delay is selected so that the bag end is sealed at a proper location to insure the garment in the bag is not damaged, but to make efficient use of bag material. The heated sealing bars 494 can be heated electrically or mechanically as suitable. For example, hot air can be used if so desired, in which case, the bars 494 will be hollow chambers with exit holes defined in the shell thereof at locations suitable to effect a sealing of the garment bags beneath the wings 476.

As shown in FIGS. 1 and 2, the discharge assembly 70 includes a downcomer tube 520 associated at one end thereof with the belt 210 to receive sealed garment bag supporting hangers therefrom. The downcomer tube 520 is sideway receding from the belt 210 and a discharge rod 521 is telescopingly received in the downcomer tube 520 at a top end thereof and has a lower end thereof connected to a rack 522 of the collection means 80 to deposit the bagged garment supporting hangers thereon. The rod 522 is telescopingly received in the tube 520 in the preferred embodiment so various collection means can be accommodated, as well as various collection means placements relative to the unit 10. Movement of such bags is indicated in FIGS. 1 and 2 by arrows 524. The collection means 80 includes a support frame 526 mounted on wheels 530 to transport bagged garments to a next operation.

The hanger support rod 290 has a terminal end 532 thereof located superjacent the downcomer tube to define a step 534 so that hangers move easily and reliably from that rod to the downcomer tube.

Figure 6:
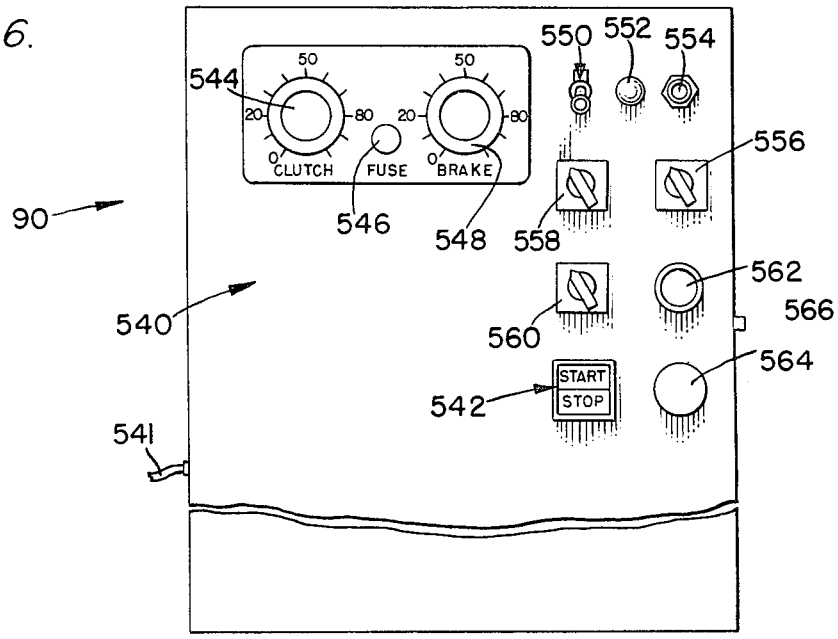
FIG. 6 is a control unit with the garment bag sealing machine embodying the teachings of the present invention.

Overall control of the sealing unit 10 is effected by the control unit 90 best shown in FIGS. 1, 6 and 7. As shown in FIG. 6, the control unit includes a control panel 540 mounted on horizontal strut 156 adjacent the belt housing and powered from an electrical source (not shown) via cable 541. The control unit is preferably solid state and includes a cycle start-stop button 542, a clutch control 544, a fuse 546, a brake control 548, a power on-off switch 550, a power light 552, a circuit breaker 554, a motor on-off switch 556 for motor 250, a clutch and break on/off switch 558, a heater on-off switch 560, a sealing bar down pushbutton 562, an emergency stop switch 564 and a sealing time rheostat 556.

As best shown in FIGS. 1 and 7, fluid is supplied to the control unit via line 570 and valve 572 mounted on cross-brace 162 from a source (not shown). The main fluid supply line is located within the pilaster braces 154 as indicated in FIG. 7. An oiler 574, an air filter 576 and an air filter automatic water dump 578 are also mounted on the cross-brace 162 and cooperate with the valve 572 to serve the purpose usual to such elements. A regulator 579 having a pressure guage is also mounted on the cross-brace 162 to cooperate with the just-described elements.

A master control valve 580 is mounted on the control panel, and fluid lines from the valve 580 supply fluid, such as air, to the sealing assembly fluid cylinders 454 and to the valve 580 to supply fluid to the escapement assembly cylinder 392. Electrical connectors 590, 592, 594 and 596 connect electrical leads 598 together and to appropriate circuitry in the control panel so that the overall operation is properly sequenced according to the preselected time delays between the actuation of the microswitches 382 and 440 and the execution of the desired operations, such as retracting the tappet shaft 396 or actuation of the sealer bars, or the like. Temperature control of the sealer unit, belt speed, and the like can also be effected using the control unit, as will be evident to those skilled in the art from this disclosure.

A sealer guard plate can be mounted beneath the ramp plate if so desired. The guard plate will be rectangular with one longitudinal edge mounted on the cross-brace 162 and the other longitudinal edge attached to the undersurface of the ramp plate. The end edges of the guard plate can be spaced from the side flanges 133 of the ramp plate if so desired.

The interconnection and cooperation of the above-discussed elements will be made clear to those skilled in the art from the ensuing disclosure of the operation of the unit 10.

A garment in an open-ended bag arrives from a previous operation on the feeder mechanism rail 360 and raises the microswitch blade 384 which causes actuation of the escapement cylinder 392 after a short time delay. The garment bag then slides down the rail 360 toward the idler pulley 214. The riveted V-link belt 210 picks up the garment hanger hook and moves it along the hanger guide rail 290. This guide rail is preferably rectangular with dimensions of $\frac{1}{2}$ inch$\times$1 inch. The bagged garment is moved underneath the dual armed ends of the bag sensors 442. The sensor arms 442 have a multipurpose; to-wit: the sensor arms 442 sense the end of a bag; stop the belt; actuate the sealer bars fluid cylinders 454; remove the excess air from a bag before initiation of the sealing step; and eliminate static electricity from the bags.

At the end of a bag signal from the microswitch 440, the belt pauses, and the sealing bars come down. The same air signal controls the down movement of two sealing bar assemblies 454 and the up movement of the escapement cylinder 392. There is only one valve, master control valve 580, to operate the sealing cylinders and the escapement cylinder. When the sealing bars go up, the escapement cylinder comes down, and the belt starts and the garment continues the travel thereof to the end of guide rail 290 whereat the hanger and bagged garment drops onto the discharge tube 520.

The bagged garment, in a gravity assisted manner, slides down the tube onto the discharge rod 522 which then is used to transfer the garment to the next operation. It is noted that the bag sensors 442 actuate microswitch 440 which is the main switch used to control overall operation.

As a bag moves from beneath sensors 442, the microswitch 440 is actuated to start the following sequence: the V-link belt 210 is stopped by disengaging a clutch of the unit 252; the sealing bars 464 come down, which bar downtime is timed by the rheostat 500; the signal from the microswitch 440 causes the escapement cylinder 392 to be actuated to raise the tappet shaft 396 and a single bagged garment slides down the apron 310 toward the V-link belt 210; the fluid cylinders 454 are actuated to raise the sealing bar pressure units 464; the escapement cylinder 392 is actuated to lower the tappet shaft 396; and a clutch in the unit 252 is engaged to restart the V-link belt 210.

It is noted that the cycle repeats automatically.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A sealing means for sealing garment bags in a garment dry cleaning or garment manufacturing operation comprising:

a support means;

a garment bag supporting ramp mounted on said support means for supporting garment bags to be sealed;

a garment bag conveyor means mounted on said support means, said bag conveyor means including a garment hanger guide rail, a conveyor belt housing, a conveyor belt mounted in said housing and a conveyor belt drive means, said conveyor belt being formed by a plurality of interconnected links with each link having a body with a leading edge and a trailing portion with the leading edge of one link body being connected to the trailing portion of an adjacent link and being offset from that trailing portion to define a step between such connected links, said belt link leading edges each cooperating with said guide rail so that said step and said guide rail form a hanger accommodating pocket;

a garment hanger feeder means mounted on said belt housing to receive hanger supported bagged garments in a dry cleaning or garment manufacturing operation and feed such hanger supported garments to said conveyor belt in a manner such that each of the hangers is received in one of said hanger accommodating pockets to directly contact one of said links to be moved along said guide rail by said conveyor belt;

garment bag sealer means mounted on said support means and sealing each garment bag as such each garment bag is conveyed through said sealer means by said conveyor means; and discharge means mounted on said belt housing for discharging sealed garment bags from said conveyor belt.

2. A sealing means for sealing garment bags in a garment dry cleaning or garment manufacturing operation comprising:

a support means;

a garment bag supporting ramp mounted on said support means for supporting garment bags to be sealed;

a garment bag conveyor means mounted on said support means, said bag conveyor means including a garment hanger guide rail, a conveyor belt housing, a V-link conveyor belt mounted in said housing and a conveyor belt drive means, said V-link conveyor belt being formed of a plurality of links which are interconnected and each offset from adjacent links to form a plurality of steps and which cooperate with said guide rail to form hanger accommodating pockets in said guide rail;

a garment hanger feeder means mounted on said belt housing to receive hanger supported bagged garments in a dry cleaning or garment manufacturing operation and feed such hanger supported garments to said conveyor belt in a manner such that each of the hangers is received in one of said hanger accommodating pockets to directly contact one of said links to be moved along said guide rail by said conveyor belt;

garment bag sealer means mounted on said support means and sealing each garment bag as such each garment bag is conveyed through said sealer means by said conveyor means; and discharge means mounted on said belt housing for discharging sealed garment bags from said conveyor belt.

3. The sealing means defined in claim 2 wherein said garment bag sealer seals each garment bag with a double seal comprising a pair of spaced seals.

4. The sealing means defined in claim 3 further including a control means associated with said feeder means, said conveyor means and said sealer means for controlling such means.

5. The sealing means defined in claim 4 wherein said control means includes a first microswitch on said feeder means and a second microswitch on said conveyor means.

6. The sealing means defined in claim 5 wherein said feeder means includes an escapement means which permits only one hanger at a time to be fed to said conveyor means, said escapement means being controlled by said first microswitch.

7. The sealing means defined in claim 6 wherein said sealer means includes a movable sealer bar which is controlled by said second microswitch.

8. The sealing means defined in claim 7 wherein said belt drive means is controlled by said second microswitch to cause said conveyor belt to pause for a predetermined amount of time when a garment bag is in a sealing position beneath said sealer bar.

9. The sealing means defined in claim 8 wherein said escapement means includes a fluid cylinder and a shaft which is moved by said cylinder into and out of the path followed by a hanger toward said conveyor belt, and said sealer means includes a fluid cylinder connected to said movable sealer bar to reciprocate that sealer bar toward and away from a garment bag supported on said supporting ramp.

10. The sealing means defined in claim 5 wherein said microswitches include sensor arms.

11. The sealing means defined in claim 6 wherein said feeder means includes a hanger support rail and an apron mounted on said hanger guide rail to associate said hanger guide rail with said hanger support rail so that hangers passed by said escapement means are fed to said conveyor belt by said apron.

12. The sealing means defined in claim 11 wherein said apron is offset from said hanger support rail to define a hanger step.

13. The sealing means defined in claim 12 wherein said belt drive means includes a drive pulley and an idler pulley with said idler pulley being located adjacent said apron.

14. The sealing means defined in claim 13 wherein said apron includes an arcuate portion adjacent said idler pulley to form a feed area whereat hangers are fed to said hanger accommodating pockets.

15. The sealing means defined in claim 9 wherein said sealer means includes a holder on one end of said movable shaft and an elongate presser pad mounted in said holder, said presser pad having a slot defined longitudinally thereof to form a pair of spaced wings on either side of said slot, said wings contacting a garment bag at spaced locations to form said pair of spaced seals.

16. The sealing means defined in claim 15 wherein said sealer means further includes a platen means mounted on said supporting ramp to be beneath said presser pad, said ramp having an opening defined therein through which said presser pad passes into contact with said platen, said platen including a heat conductive bar and a heating means connected to said bar to heat said bar to a temperature sufficient to effect a seal of a garment bag.

17. The sealing means defined in claim 16 wherein said platen further includes a temperature control means connected to said heating element.

18. The sealing means defined in claim 17 wherein said platen further includes a cover positioned on said heat conductive bar to be interposed between said bar and a garment on said ramp.

19. The sealing means defined in claim 9 wherein said control means includes a master valve and said escapement fluid cylinder and said sealer fluid cylinder receive fluid from said master valve.

20. The sealing means defined in claim 2 wherein said ramp is tilted with respect to horizontal and includes a garment bag lead-on means.

21. The sealing means defined in claim 2 wherein said discharge means includes a discharge tube connected to said belt housing and receding sideways from said housing.

22. The sealing means defined in claim 21 wherein said discharge means further includes a discharge rod telescopingly received in said discharge tube.

23. The sealing means defined in claim 22 further including a garment bag collection means connected to said discharge rod to receive bagged garments therefrom.

24. The sealing means defined in claim 4 wherein said control means includes a master control panel with which an operator controls operation of the overall sealing unit.

25. The sealing means defined in claim 6 wherein said feeder means further includes a hanger guide located adjacent said escapement means.

26. The sealing means defined in claim 2 further including a hanger guide on said belt housing.

27. The sealing means defined in claim 2 further including a layer of low friction, abrasive resistant material on said hanger guide rail.

28. The sealing means defined in claim 2 wherein said conveyor belt is vertically oriented to have an upper reach and a lower reach with said lower reach being located adjacent said hanger guide rail.

29. The sealing means defined in claim 28 wherein said hanger guide rail is mounted on said support means.

30. The sealing means defined in claim 7 wherein said sealer means further includes guide means on said movable sealer bar.

31. The sealing means defined in claim 7 wherein said sealer means includes a pair of movable sealer bars.

32. The sealing means defined in claim 10 wherein said second microswitch includes a pair of sensor arms.

33. The sealing means defined in claim 2 wherein said conveyor belt includes a projection on each link.

34. The sealing means defined in claim 33 wherein said projections comprise rivets.

35. The sealing means defined in claim 33 wherein said projections contact said hanger guide rail.

36. A sealing means for sealing garment bags in a garment dry cleaning or garment manufacturing operation comprising:

a support means;

a garment bag supporting ramp mounted on said support means for supporting garment bags to be sealed;

a garment bag conveyor means mounted on said support means, said bag conveyor means including a garment hanger guide rail, a conveyor belt housing, a conveyor belt mounted in said housing and a conveyor belt drive means, said conveyor belt being formed by a plurality of interconnected links each offset from adjacent links and cooperating with said guide rail to form a plurality of hanger accommodating pockets;

a garment hanger feeder means mounted on said belt housing to receive hanger supported bagged garments in a dry cleaning or garment manufacturing operation and feed such hanger supported garments to said conveyor belt in a manner such that each of the hangers is received in one of said hanger accommodating pockets to directly contact one of said conveyor links and be moved along said guide rail by said conveyor belt;

garment bag sealer means mounted on said support means and sealing each garment bag as such each garment bag is conveyed through said sealer means by said conveyor means; and discharge means mounted on said belt housing for discharging sealed garment bags from said conveyor belt.

* * * * *